US008276795B1

(12) United States Patent
Dean et al.

(10) Patent No.: US 8,276,795 B1
(45) Date of Patent: Oct. 2, 2012

(54) MODULAR AMMUNITION RESTRAINT SYSTEM FOR AMBUSH PROTECTED VEHICLES

(75) Inventors: Glenn Dean, Lake Hopatcong, NJ (US); Eugene Michael Ivankoe, Chatham, NJ (US); Margaret Berkowitz, Wharton, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 289 days.

(21) Appl. No.: 12/777,477

(22) Filed: May 11, 2010

(51) Int. Cl.
*B60R 7/14* (2006.01)

(52) U.S. Cl. ..... 224/543; 244/547; 244/563; 244/568; 244/931

(58) Field of Classification Search ..... 224/931, 224/543, 547, 563, 555–558, 568, 567, 42.39, 224/42.4; 211/94.01; 220/666; 89/34
See application file for complete search history.

(56) References Cited

U.S. PATENT DOCUMENTS

| | | | | |
|---|---|---|---|---|
| 1,385,640 | A * | 7/1921 | O'Keefe | 224/42.39 |
| 5,133,489 | A * | 7/1992 | Loew et al. | 224/42.39 |
| 5,139,186 | A * | 8/1992 | Loew et al. | 224/42.39 |
| 5,211,716 | A * | 5/1993 | Tobias | 190/103 |
| 5,284,082 | A * | 2/1994 | Sprafke et al. | 89/36.13 |
| 6,481,604 | B1 * | 11/2002 | Beene et al. | 224/404 |
| 7,025,238 | B2 * | 4/2006 | Hughes et al. | 224/671 |
| 7,484,631 | B2 * | 2/2009 | Bothun et al. | 211/162 |
| 7,780,026 | B1 * | 8/2010 | Zuckerman | 220/23.4 |
| 7,918,371 | B2 * | 4/2011 | Wilson | 224/196 |
| 7,954,648 | B2 * | 6/2011 | Takashima et al. | 211/59.3 |
| 2008/0296331 | A1 * | 12/2008 | Klosk | 224/547 |
| 2008/0302744 | A1 * | 12/2008 | Rosenberg | 211/94.01 |

* cited by examiner

*Primary Examiner* — Justin Larson
(74) *Attorney, Agent, or Firm* — Michael C. Sachs

(57) ABSTRACT

Flexible restraint devices (MARS units) are provided for holding ammunition and ammunition packaging containers, mounted through wall mounting rails onto the interior of an ambush protected vehicle, or the like.

11 Claims, 6 Drawing Sheets

MODULAR AMMUNITION RESTRAINT SYSTEM FOR AMBUSH PROTECTED VEHICLES

U.S. GOVERNMENT INTEREST

The inventions described herein may be made, used, or licensed by or for the U.S. Government for U.S. Government purposes.

BACKGROUND OF INVENTION

There is a present need to resolve an ammunition stowage problem within the RG-31 Mine Resistant, Ambush Protected (MRAP) vehicle and like scenarios. Stowage of ammunition within the ammunition's shipping and storage containers is extremely limited. MRAPs have a small stowage frame that is significantly undersized for the quantity of ammunition the war fighter requires. As such, soldiers have resorted to a variety of improvised methods for securing additional ammunition within the vehicle. These methods have unfortunately proven to cause safety issues where soldiers have sustained injury as a result of vehicle roll-over or explosive shock from hitting IEDs. Solutions are needed that could allow soldiers to easily and quickly secure ammunition containers safely within the available interior free space. The solution must be safe, adaptable to not just the RG-31, but all MRAPs, accommodate a broad range of container sizes, and be easily attached within the vehicle by personnel in the more forward echelons. Ideally, the solution should allow modularity to add restraint to individual containers.

BRIEF SUMMARY OF INVENTION

This invention provides a modular ammunition restraint system (MARS) which could be used in an MRAP environment. This flexible bag concept addresses many of the shortcomings and offers benefits not currently available to the combatant. The mountable/demountable MARS flexible bag provides a secure method for interior stowage, can be easily accessed, can be designed to be modular, and can be easily mounted by field personnel. It will be seen that the MARS device will provide a method for attaching and securing ammunition containers to the interior of vehicles, such as, but not limited to MRAP vehicles, such that said an ammunition container can be removed and/or accessed quickly, and with or without the aid of tools.

OBJECTS OF THE INVENTION

It is an object of the present invention to provide means for safely and conveniently stowing assorted ammunition and/or assorted ammunition packaging containers, within the confined space of a small armored combat vehicle.

Another object of the present invention is to provide a selectively expandable box-like restraining device which can be easily mounted/demounted on the interior walls of a small armored combat vehicle, which can be used to safely stow assorted ammunition and/or assorted ammunition packaging containers.

Yet another object of the present invention is to provide a modular system of multiple restraining devices, any ones of which can be selectively used to safely stow assorted ammunition and/or assorted ammunition packaging containers as desired, in any or in all of such restraining devices.

Still another object of the present invention is to provide a modular system of multiple restraining devices any ones of which can be selectively and easily mounted on/demounted from the interior walls of a small armored combat vehicle, which devices can be used as desired to safely stow assorted ammunition and/or assorted ammunition packaging containers.

These and other objects, features and advantages of the invention will become more apparent in view of the within detailed descriptions of the invention and in light of the following drawings. It should be understood that the sizes and shapes of the different components in the figures may not be in exact proportion and are shown here for visual clarity and for purpose of explanation.

DESCRIPTION OF DRAWINGS

FIG. 1 and more particularly FIG. 1A show the concept of a plurality 100 of MARS units 200 mounted through wall mounting rail(s) 101, onto the interior walls of an ambush protected vehicle or the like.

DETAILED DESCRIPTION

Figure 1:
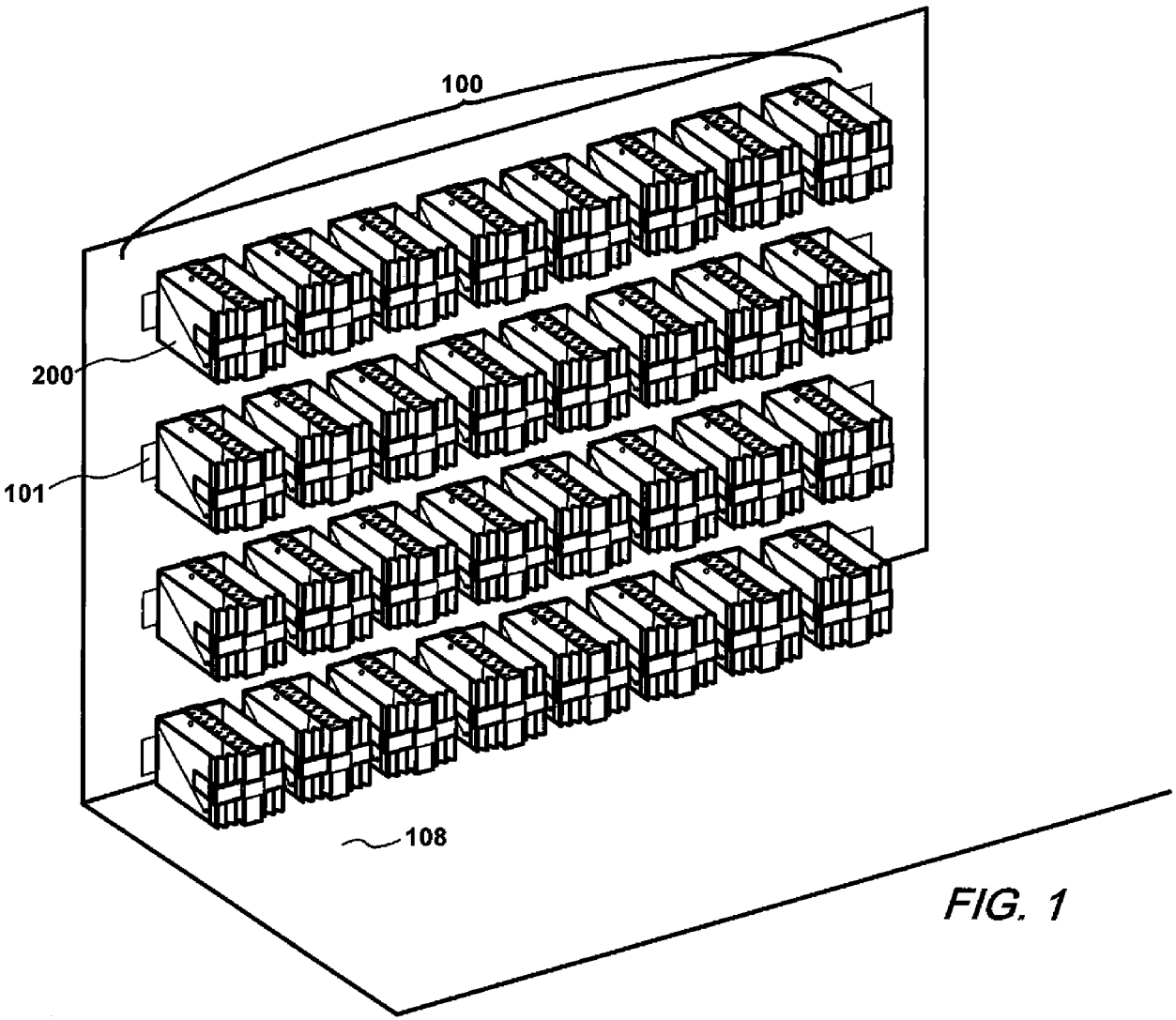
Figure 1A:
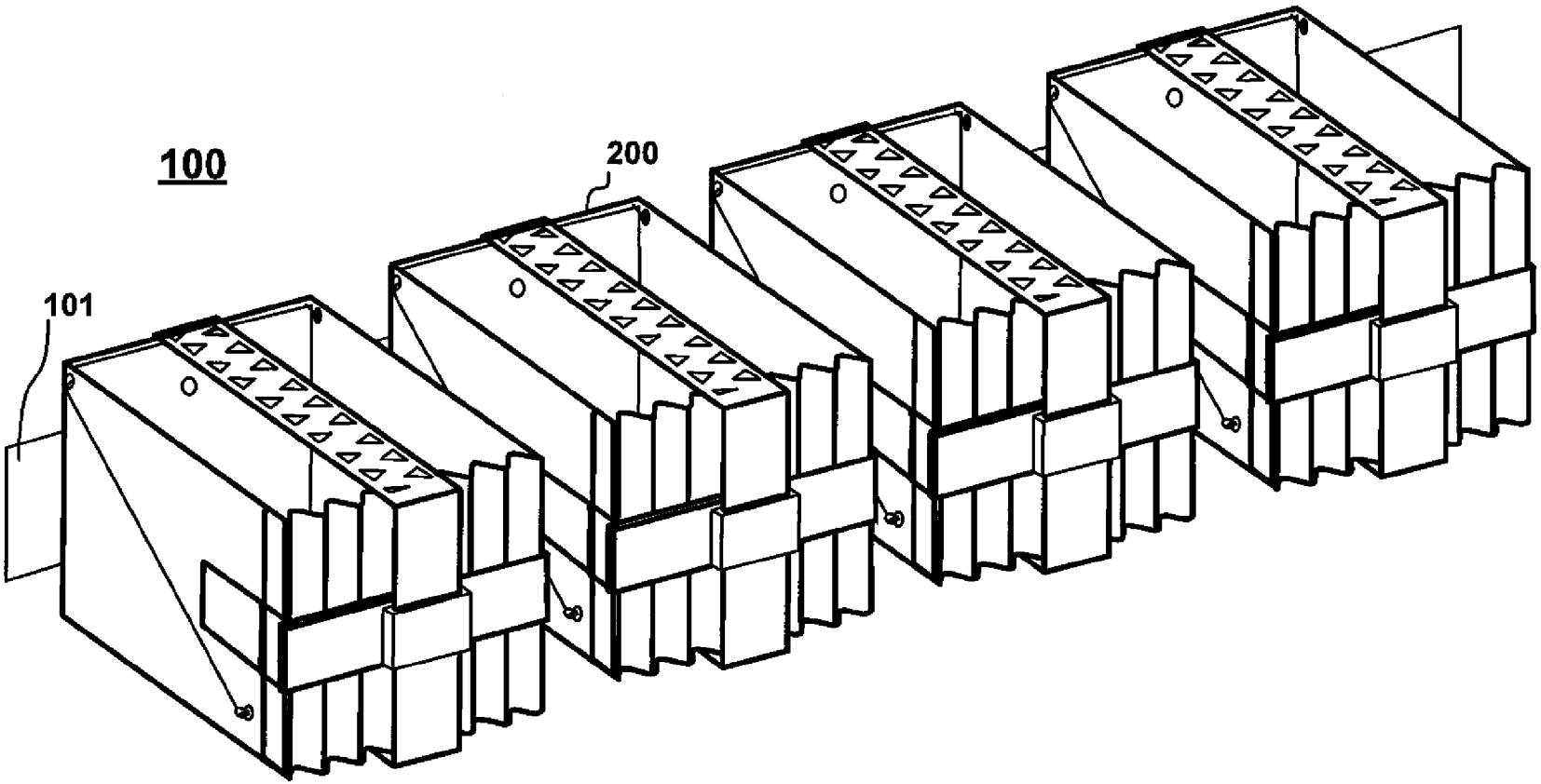

FIG. 1 and more particularly FIG. 1A show the concept of a plurality 100 of MARS units 200 mounted through wall mounting rail(s) 101, onto the interior walls of an ambush protected vehicle or the like.

Figure 2:
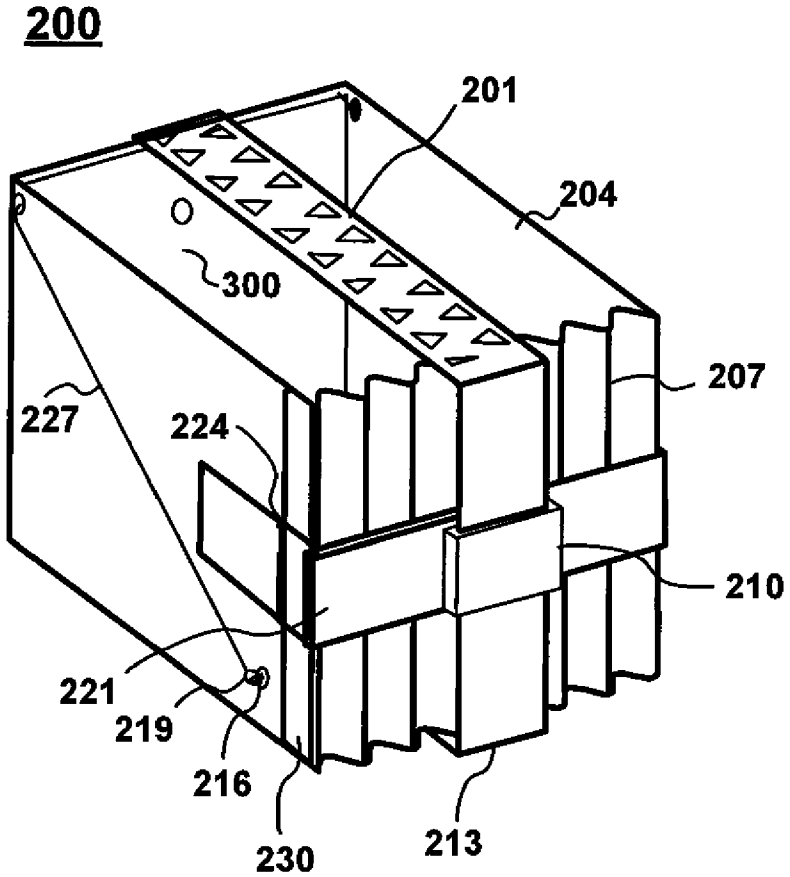
FIG. 2 shows an exploded view of an individual MARS unit 200 according to the invention.
Figure 3:
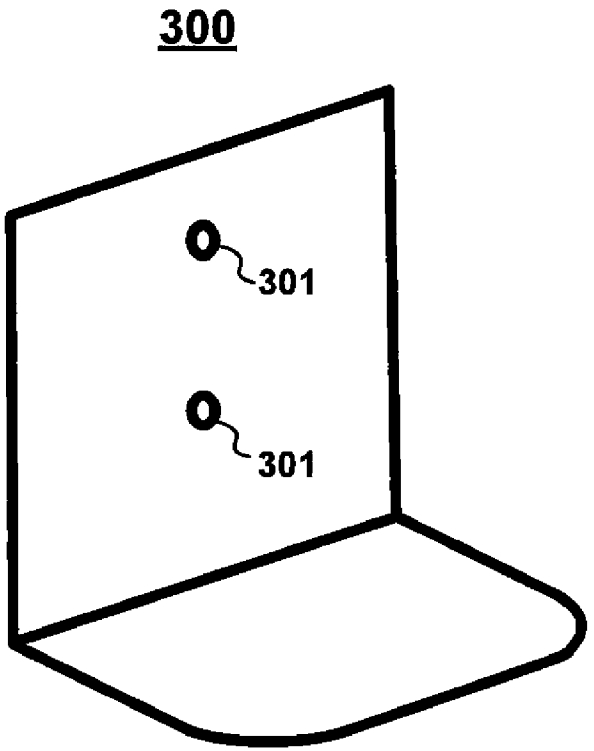
FIG. 3 shows reinforcing plate 300 with mounting holes 301 for attachment of each MARS unit to the wall mounting rail attachment means 101.
Figure 4:
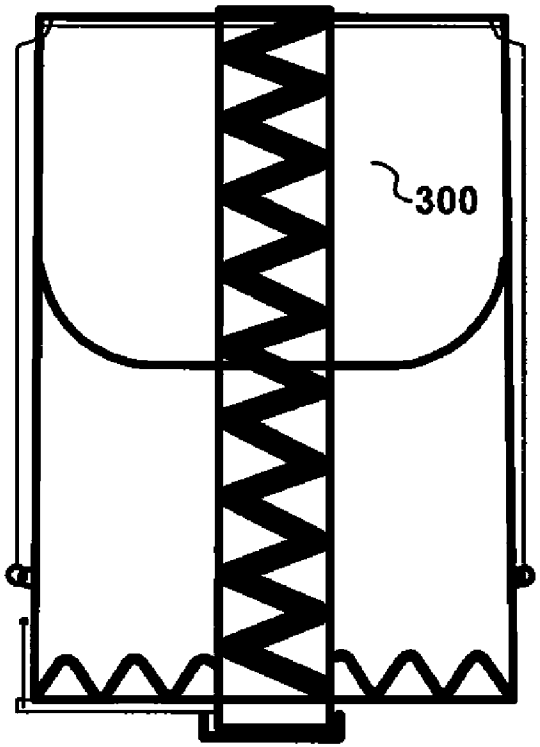
FIG. 4 shows a top view of a MARS device.
Figure 5:
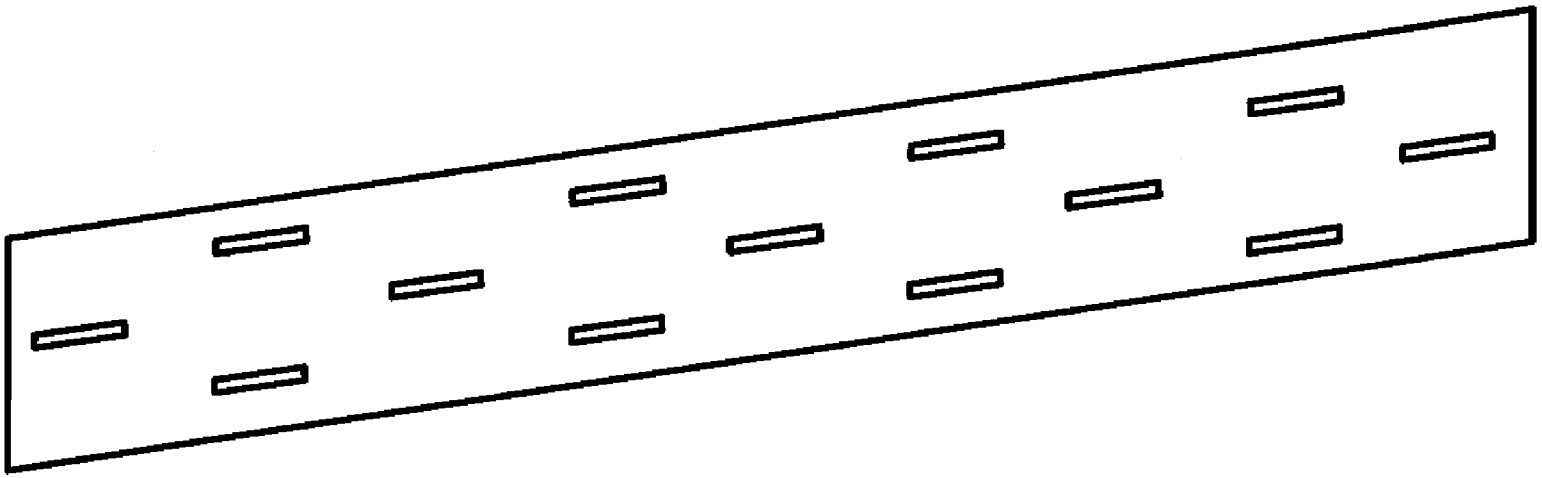
FIG. 5 shows an illustration of a mounting rail 101.

In FIG. 2, flexible restraining device 200 is made from any flexible material 204, such as, but not limited to, fabric (ballistic nylon, Cordura), plastic or rubber. Fabric, or other suitable flexible material 204 is further reinforced with other stiff material such as metal, rubber, foam or plastic sheet. Panels are assembled through the use of stitching, using thread, or other suitable methods for assembly. The edge of the flexible material may be reinforced with a hook and loop strip 230 (as part of hook and loop closure means 213). Stiffening material can either be made within (sandwiched), or added to either side of the flexible material. Restraint can be attached on reinforcing plate 300 to attach the device 200 to the wall of a vehicle, e.g., by use of any suitable fastener, such as, but not limited to, nut and bolt, quick release (ball type) pins, or any method for mechanical attachment. Such restraint would be adjustable to accommodate any size container rectangular container, such as a PA108, M19A1, or a M2A1, or the like. Adjustment is by means of accordion style or other flexible fabric or solid material 207 that is secured by webbing 201, by means of hook and loop closure means 213 (having hook and loop 221 and fastener) on one of the faces of the flexible restraining device 200. Restraining device 200 can be made to accommodate larger rectangular containers, such as, but not limited to, an M548. Ammunition container is restrained from vertical travel by means of flexible webbing attached to a snap buckle 210, D-ring 224, or other suitable means of engagement. Webbing is secured by stitching, riveting, ultrasonic welding or other suitable method for attachment onto the restraint device 200. The device is further prevented from sagging under load by means of the metal reinforcing plate 300, by the hook and loop means (213, 221), by the webbing 201 which is bent down the front face at a 90 degree angle so that it can be attached at snap buckle 210 to the hook and loop means, and also by a wire rope 227 or by other suitable method for providing structural rigidity. A selected quantity of these MARS devices 200 can be attached to the interior of a vehicle by means of a mounting rail attachment means 101. Attachment is made by using a suitable fastener (not entirely shown) to secure each MARS device individually to the mounting rail by means of a quick release type fastener, such as, but not limited to a quick release ball type pin or other suitable method for attachment, with or without the aid of tools. The mounting rail can be made from metal or other suitable structural material, such as composite plastic, to facilitate the secure mounting of each MARS device. Mounting rail placement is by any method of securing the mounting rail to the vehicle's structure (usually the interior) over a broad dimensional range. The mounting rail may be sized in length to allow placement within different vehicles. The mounting rail may be attached by means of fasteners, such as but not limited to bolts, quick release ball type pins, C-clamps, welding or other such method to secure the mounting rail to a select vehicle. FIG. 3 shows reinforcing plate 300 with mounting holes 301 for attachment of the MARS device to the wall mounting rail attachment means 101. FIG. 4 shows a top view of the MARS device and FIG. 5 shows an illustration of a mounting rail 101.

While the invention may have been described with reference to certain embodiments, numerous changes, alterations and modifications to the described embodiments are possible without departing from the spirit and scope of the invention as defined in the appended claims, and equivalents thereof.

What is claimed is:

1. A modular ammunition restraint system comprising in combination:

a plurality of wall mounting rails, a multiplicity of modular containers for restraining assorted ammunition and assorted ammunition packaging, said modular containers mounted on said wall mounting rails, and, each modular container further comprising:

a box shaped flexible restraining device made from a flexible fabric reinforced with stiff material added to sides of said flexible fabric of said device; a rear metal reinforcing plate for attachment of the device to a wall mounting rail, a front face of said device being accordion style flexible fabric that is length adjustable to accommodate size of assorted contents of said device, said accordion style flexible fabric being secured by means of a hook and loop with fastener on said front face of the device, and by an overhanging metal webbing attached to said rear metal reinforcing plate then arching forward, then bent downward to attach to the fastener at the front face by a snap buckle means.

2. The modular ammunition restraint system of claim 1, wherein the restraining devices would be selectably adjustable to accommodate different size rectangular ammunition containers.

3. The modular ammunition restraint system of claim 1, wherein the ammunition container comprises a PA108, an M19A1, an M2A1, or an M548.

4. The modular ammunition restraint system of claim 2, further wherein said ammunition containers are restrained from vertical movement by means of said overhanging webbing.

5. The modular ammunition restraint system of claim 1, further wherein said overhanging webbing is fastened at the front face by said snap buckle means and a D-ring means of engagement, and wherein said overhanging webbing is secured by riveting onto said restraining device.

6. The modular ammunition restraint system of claim 1, further wherein said restraining device is prevented from sagging under load by means of the metal reinforcing plate, by a hook and loop means, and by having the overhanging metal webbing attached for providing structural rigidity.

7. The modular ammunition restraint system of claim 1, further including a horizontal strap with hook and loop and D-ring.

8. The modular ammunition restraint system of claim 1, further wherein said rear metal reinforcing plate is attached to a mounting rail on an interior wall of a vehicle, by use of a bolt with a nut.

9. The modular ammunition restraint system of claim 1, further wherein said rear metal reinforcing plate is attached to a mounting rail on an interior wall of a vehicle.

10. The modular ammunition restraint system of claim 1, further wherein said mounting rail is of composite plastic.

11. The modular ammunition restraint system of claim 1, further wherein said wall mounting rails are attached on an interior wall of a vehicle.

* * * * *